US005677964A

United States Patent [19]

Sun

[11] Patent Number: 5,677,964

[45] Date of Patent: Oct. 14, 1997

[54] EARPHONE

[76] Inventor: Ming-Han Sun, 7F, No. 213-2, Sec. 2, An-Ho Rd., Taipei, Taiwan

[21] Appl. No.: 714,536

[22] Filed: Sep. 16, 1996

[51] Int. Cl.[6] ..... H04R 25/00

[52] U.S. Cl. ..... 381/187; 381/183; 381/189; 381/154; 381/68.7

[58] Field of Search ..... 381/187, 183, 381/154, 153, 68, 69, 68.6, 68.7; 181/135, 137; 379/430

[56] References Cited

U.S. PATENT DOCUMENTS

| | | | |
|---|---|---|---|
| 2,513,746 | 7/1950 | Rohr | 381/69 |
| 4,020,297 | 4/1977 | Brodie | 379/430 |

FOREIGN PATENT DOCUMENTS

| | | | |
|---|---|---|---|
| 788099 | 12/1957 | United Kingdom | 381/68.6 |

*Primary Examiner*—Sinh Tran
*Attorney, Agent, or Firm*—Beveridge, DeGrandi, Weilacher & Young LLP

[57] ABSTRACT

A safe earphone generally includes a housing, water-proof seal, speaker, ear cushion, upper lid and a loop-type retainer is removably attached to the housing. Wherein the speaker is disposed with the ear cushion and the water-proof seal by its upper and bottom sides within the speaker chamber of the housing. The upper side is enclosed by the upper lid. The loop-type retainer is attached to the sound directing tubes with its both ends. The housing is with/without an opening according to its application. As a result, the earphone made according to this invention can be divided into speech-type and music-type. The loop-type retainer can be readily enveloped onto the helix of the ear by its resilient property. When external force is applied to the loop-type retainer, the retainer may be readily deprived therefrom to protect the helix without being injured. This arrangement ensures a safe and comfortable wearing situation. The sound wave generated by speaker is transmitted via the loop-type retainer and going out from the opening (music-type). Then the woofer is enhanced and a stereo effect is achieved. The music quality is highly increased. On the other hand, the rearward sound wave may be degenerated within the loop-type retainer (speech-type) to decrease the negative resonating effect. The quality of voice is therefore upgraded. The information is clearly transmitted.

2 Claims, 9 Drawing Sheets

EARPHONE

FIELD OF THE INVENTION

This invention relates to an earphone, more particularly, to an earphone with loop-type retainer for an easy and comfortable attachment to the outer ear of the wearer while provides stereo enhanced woofer effect with music type as well as clear voice with speech type. The earphone generally includes a housing, water-proof seal, speaker, ear cushion and upper lid. A loop-type retainer is removably attached to the housing for a comfort and robust attachment with the outer ear. On the other hand, the housing may be provided with an opening for sound transmitting.

DESCRIPTION OF PRIOR ART

The earphone has been widely used in telecommunication and music listening. In general, the earphone can be divided into the following types.

1. Earphone: As shown in FIG. 1, the earphone housing (A) has an extension (A1) thereof which has an opening (A2) at free end. In practice, the extension (A1) is inserted into the outer auditory canal, then the voice broadcasted therefrom can be heard by the user. Nevertheless, the earphone has no retaining device thereof for the attachment with the outer ear or the auditory canal. In case of too loose, the earphone may fall off from the auditory canal, in case of too tight the auditory canal will be injured. On the other hand, for a prolong usage, the user will suffer uncomfort, disorder of nervous, headache and even the cochlea.
2. Earphone with clipping hooker: As shown in FIG. 2, this type of earphone is similar to earphone shown in FIG. 1, except there is a clipping hooker (B2) disposed at the housing (B) which has an extension (B1) thereof. In practice, the extension (B1) is inserted into the outer auditory canal and the clipping hooker is anchored to the helix. By this arrangement, even the earphone is prevented from falling off from the outer auditory canal, the user may still suffer those inconvenience since the extension (B1) is still inserted into the outer auditory canal.
3. Earphone with sleeve ring: As shown in FIG. 3, in this earphone, a sleeve ring (C1) is integral to the housing (C). In practice, the sleeve ting is enveloped to the helix. Since the helix is soft and foldable, when the sleeve ring is to be enveloped, the helix is firstly folded and compressed, when the sleeve ring is positioned, the external force is released to restore the helix. By this arrangement, the housing of the earphone runs parallel with the ear for sound transmitting.

However, the housing (C) and the sleeve ring (C1) are made from rigid material and with predetermined dimensions. Besides, there is no angular adjustment between the housing (C) and the sleeve ring (C1). With this predetermined dimension, the sleeve ring can not be fitted to the ear of all kinds of users. In case of a larger helix, it is difficult to wearing on it. Furthermore, a prolong wearing will suffer the helix. For the small helix, the sleeve ring is too loose to position thereon. Most important when the connecting wires is blocked or pulled by external force, the rigid sleeve ring may cause a serious injury to the helix. In conclusion, this type of earphone has potential danger.

Besides, the frequency ranges of the earphone limited by the area, material of the conventional earphone. On the other hand, the resonating of the speaker will generate a forward wave and a rearward wave. The forward wave will enter the auditory canal while the rearward wave will cause a resonating effect since it is not processed. In light of this, this resonating effect may negatively influence the quality of sound.

SUMMARY OF THE INVENTION

It is the object of the invention is to provide a novel earphone wherein a soft and resilient loop-type retainer is attached to the earphone to provide a comfortable positioning to the helix of the ear of the user. Furthermore, this novel earphone features water-proof and excellent sound quality.

BRIEF DESCRIPTION OF THE DRAWINGS

The objects and advantages will be better understood from the following description in conjunction with the following designs, in which like reference numbers identify identical elements and wherein.

DETAILED DESCRIPTION OF THE PREFERRED EMBODIMENT

Figure 1:
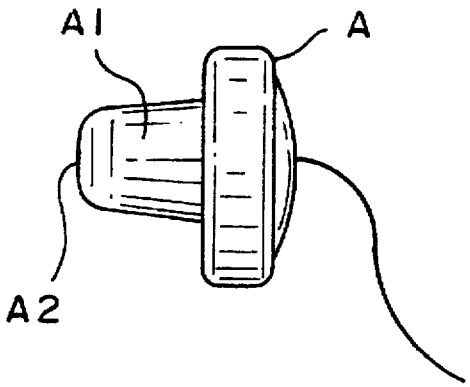
FIG. 1 PRIOR ART
FIG. 1 shows a conventional earphone.
Figure 2:
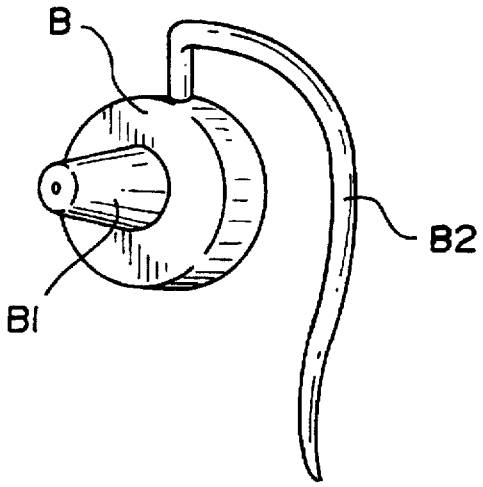
FIG. 2 PRIOR ART
FIG. 2 shows still a conventional earphone which has a clipping hooker thereof.
Figure 3:
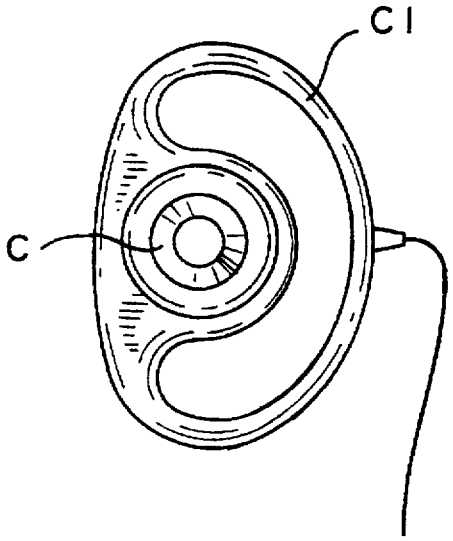
FIG. 3 PRIOR ART
FIG. 3 shows yet still a conventional earphone which has a sleeve ring thereof.
Figure 4:
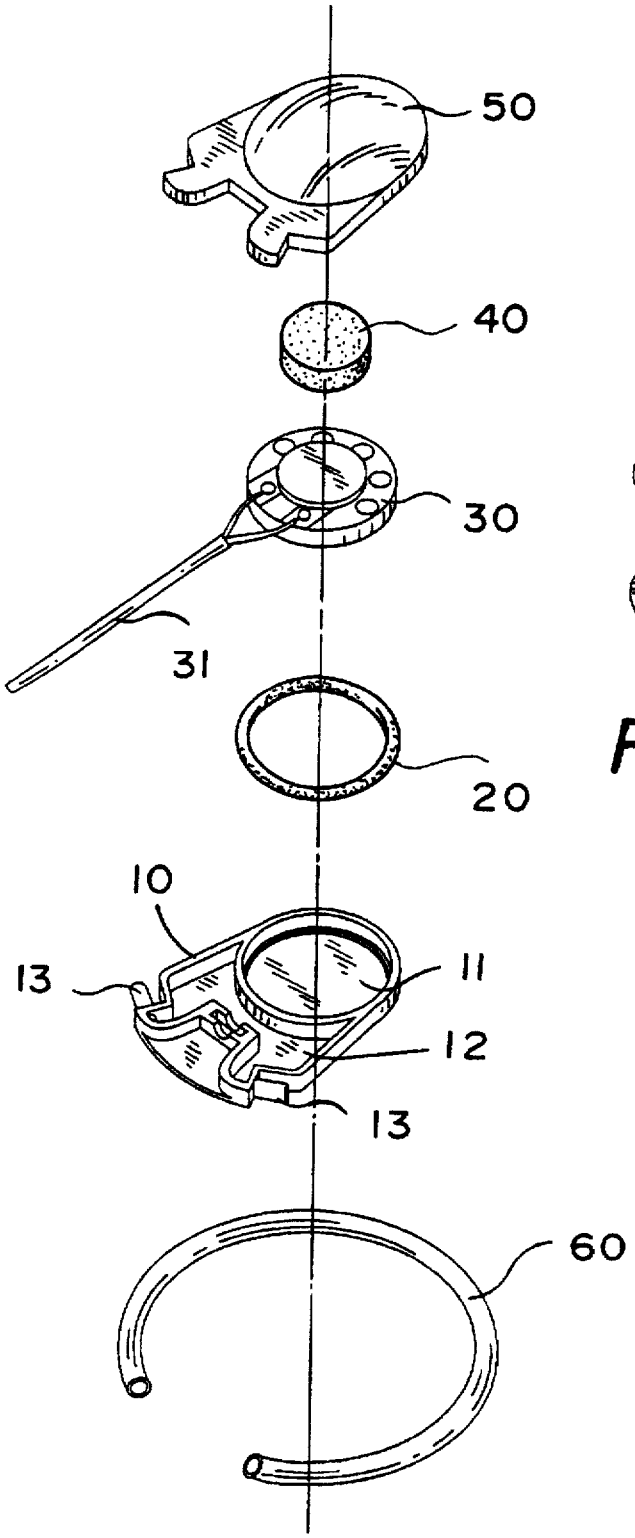
FIG. 4 is an exploded perspective view of the speech-type earphone made according to this invention.
Figure 5:
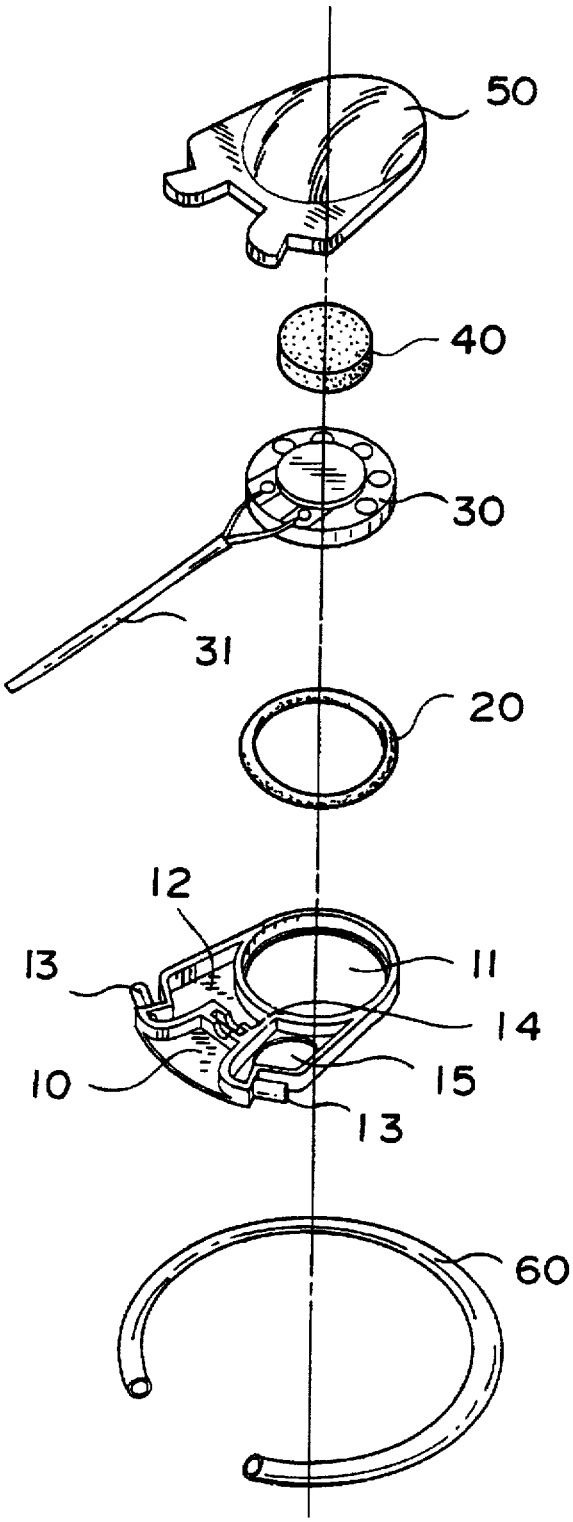
FIG. 5 is an exploded perspective view of the music-type earphone made according to this invention.

Referring to FIGS. 4 and 5, the earphone made according to this invention generally includes a housing 10, a water-proof seal 20, a speaker 30, ear cushion 40 and upper lid 50. A loop-type retainer 60 is removably attached to the housing 10 for a comfort and robust attachment with the outer ear. Each of these components will be described detailedly as follow.

Said housing 10 defines a speaker chamber 11 therein. A sound wave directing chamber 12 is extended rearward from said speaker chamber 11. Each of the sides of said sound wave directing chamber 12 is provided with a sound wave directing tube 13 which extends through said directing chamber 12 and communicates with outsides. Since the earphone made according to this invention can be divided into speech-type and music-type, accordingly, the housing 10 has a different configuration, wherein FIG. 4 shows a speech-type which has no partitioning wall-within the directing chamber 12 while FIG. 5 shows the music-type and it has a partitioning wall 14 within the directing chamber 14, consequently, the directing chamber 12 of music-type earphone is divided into a larger and small individual chambers. The small chamber has an opening 15 for communicating with outsides.

Said water-proof seal 20 is disposed within said speaker chamber 11 of said housing. Said seal 20 is made from resilient material, such as the plastic, soft PVC.

Said speaker 30 has a diaphragm with preset diameter and can be disposed within said speaker chamber 11 of said housing 10. A signal transmitting lines are connected thereof.

Said ear cushion 40 has suitable diameter and thickness.

Figure 4A:
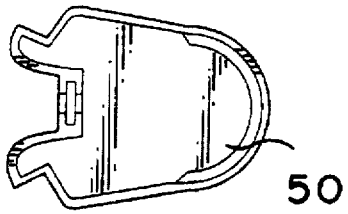
FIG. 4A is a bottom view of the upper lid of the earphone shown in FIG. 4.
Figure 5A:
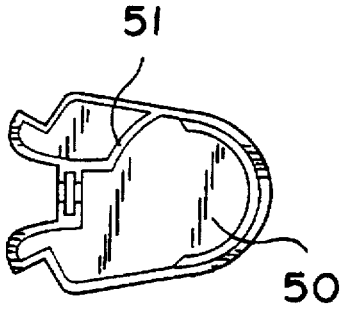
FIG. 5A is a bottom view of the upper lid of the earphone shown in FIG. 4.

Said upper lid 50 has the same contour of said housing 10 and is capable of enclosing to said housing 10 thereon. The upper lid 50 has different configuration in speech-type and music-type. As shown in FIG. 4A, the upper lid 50 used in speech-type has a hollow space while the upper lid 50 used on music-type, as shown in FIG. 5A, has partitioning wall 51 corresponding to said partitioning wall 14 of said housing 10. Accordingly, the upper lid 50 is divided into a larger space and a small space which has an opening 15 communicates with outsides.

Said loop-type retainer 60 which has a hose configuration is made from resilient material, such as the silicone rubber with suitable length and can be folded randomly. The inner diameter of said hose is matched to said sound directing tube 13 of said housing 10 and can be attached thereof.

As shown in FIGS. 6 to 10, those components can be assembled in order to construct the earphone made according to this invention. Firstly, the water-proof seal 20, speaker 30 and said eat cushion 40 are assembled into the speaker chamber 11 of said housing 10. Then the upper lid 50 is applied to enclose those components into the housing 10. Consequently, an earphone with sound wave directing chamber 12 is assembled. At last, the loop-type retainer 60 is attached to the sound directing tube 13 of the housing 10. In this configuration, the loop-type retainer 60 serves a retainer as well as a sound transmitting device. During the normal application, the loop-type retainer 60 has a dose attachment with the helix of the ear, it will not fall off therefrom.

Figure 11:
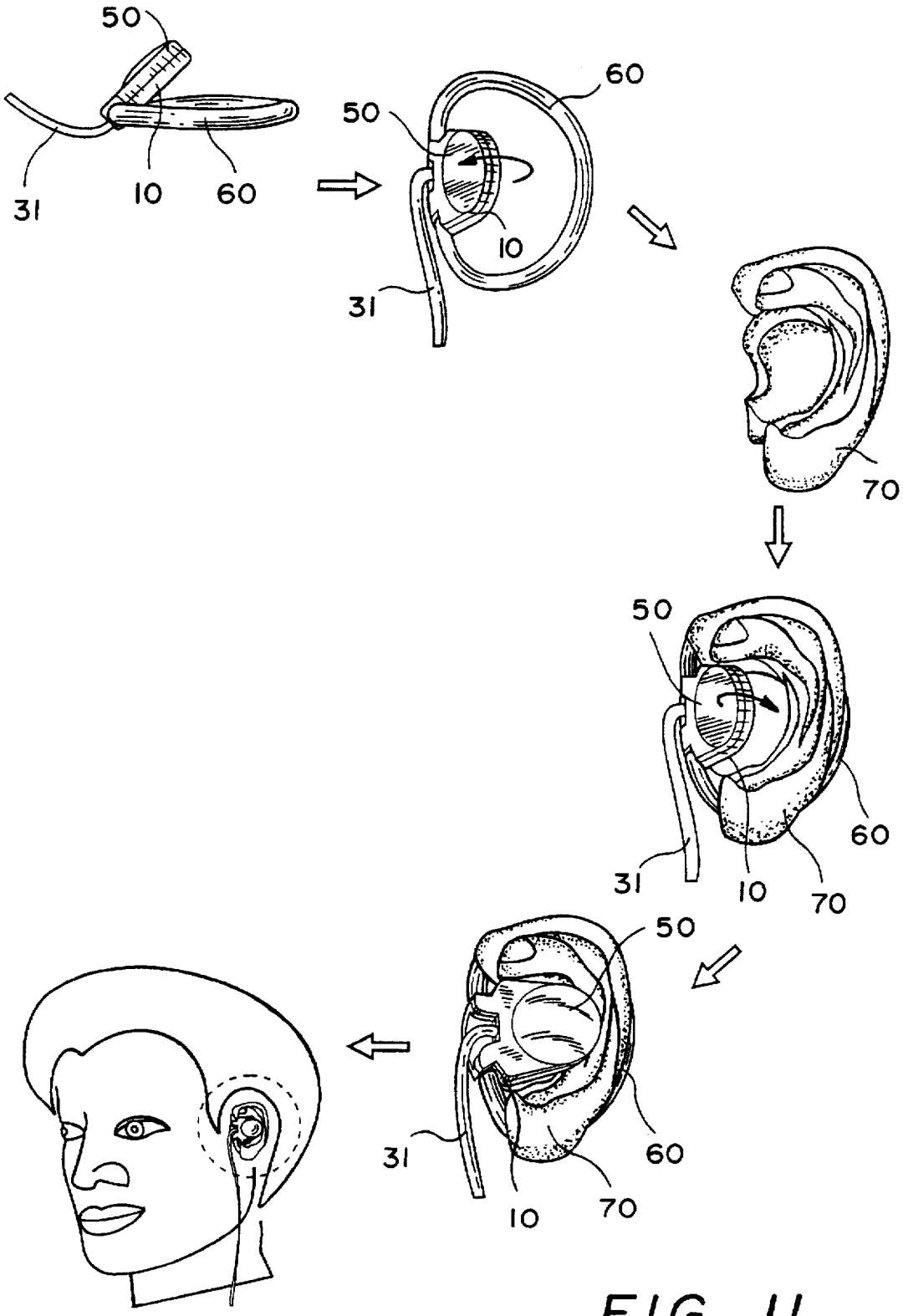
FIG. 11 shows the wearing procedures of the earphone made according to this invention.
Figure 12:
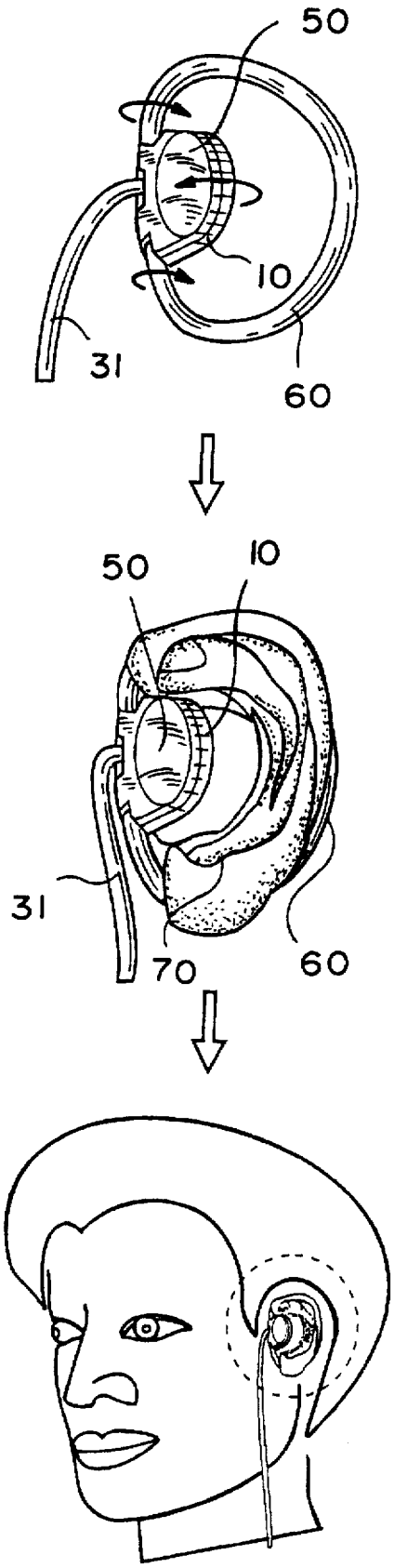
FIG. 12 shows the angular adjustment between the earphone and the ear.

Now, the wearing of the earphone made according to this invention will be described in step by step procedures. Referring to FIG. 11, since the loop-type retainer 60 is made from resilient material which can be readily extended and expanded to envelop onto the helix 70 of the ear. When the external force is released, the loop-type retainer 60 restores to its original position and construct a compact position with the helix 70 of the ear. Since the retainer 60 is made from resilient material and with hollow configuration, not only will it be readily attached to the helix of the ear, but also will bring no uncomfort to the helix of the ear. Besides, since the loop-type retainer 60 is sleeved onto the sound directing tube 13, the angle between the earphone and the ear can be readily adjusted to meet different wearing situations and safety requirements, for example during the motorbike riding. As Shown in FIG. 12, the housing 10 can be folded outward to get a suitable angular arrangement. Consequently, the wearer will feel no compression while enjoy clear and high quality voice and external information. Accordingly, the riding safety can be ensured while the wearer still enjoy excellent music or speech.

In marketing, the loop-type retainer 60 is separated with the earphone and is supplied with a longer length. The user may select a most favorable length to meet his/her personal requirement, the size of the helix. When the length of said retainer 60 is determined, both ends of said retainer 60 can be attached to the sound directing tube 13 of said housing 10. Then the earphone is at last assembled.

On the other hand, since the connection between the loop-type retainer 60 and said directing tube 13 is not permanently fixed, when the signal transmitting wires 31 is blocked and a large external force is exerted onto the earphone and retainer 60, the retainer 60 may readily deprived from the directing tube 13 to avoid the injury to the helix. Accordingly, safety is ensured. By the way, a water-proof seal 20 is provided to the speaker 30, then the earphone made according to this invention is suitable for diving activity.

Since the earphone made according to this invention can be divided into speech-type and music-type, the configuration of the upper lid 50 and housing 10 are slightly different therebetween.

Figure 6:
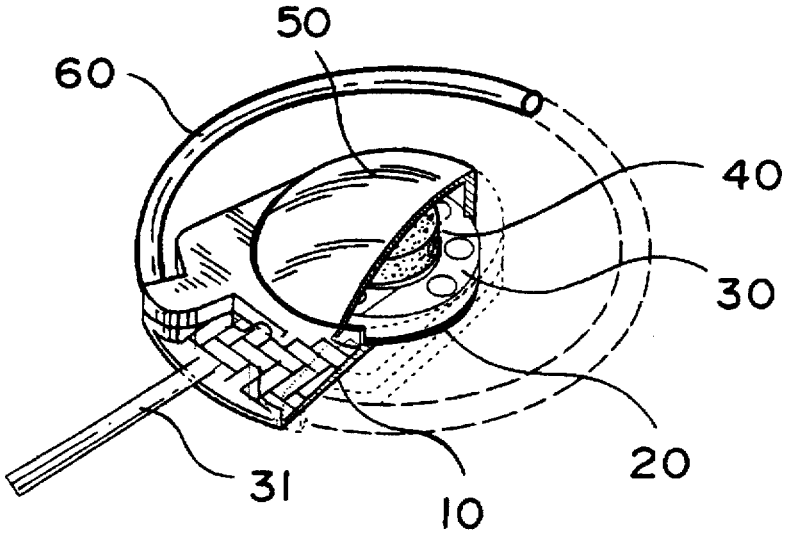
FIG. 6 is a cross sectional view of the earphone shown in FIG. 4 taking along its longitudinal axis.
Figure 13:
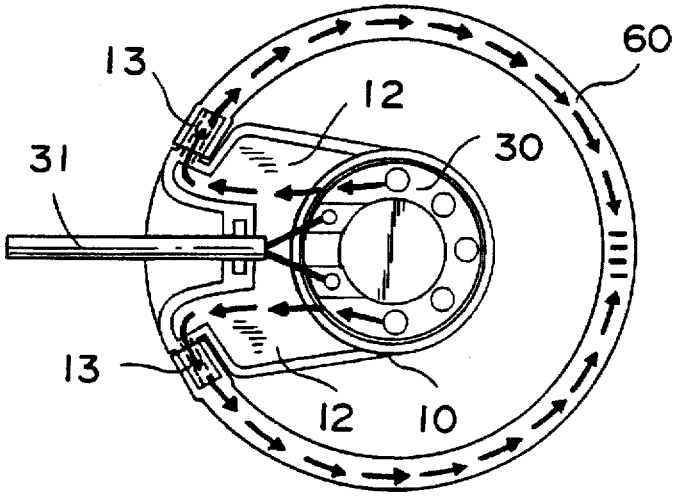
FIG. 13 shows the transmitting status of the rearward wave in a speech-type earphone made according to the present invention.

As shown in FIGS. 4, 6 and 13, the sound wave directing chamber 12 is communicated by means of the sound directing tube 13 and the retainer 60. When the speaker 30 receives signal transmitted from the signal transmitting wires 31, the diaphragm is resonated to generate a forward and rearward wave. The forward wave may enter the outer auditory canal directly while the rearward wave is degenerated as it is split and transmitted from the sound directing tube 13 and meet each other within the retainer 60, as shown in FIG. 13. By this arrangement, the resonating influence is positively reduced and the quality of voice is increased.

Figure 7:
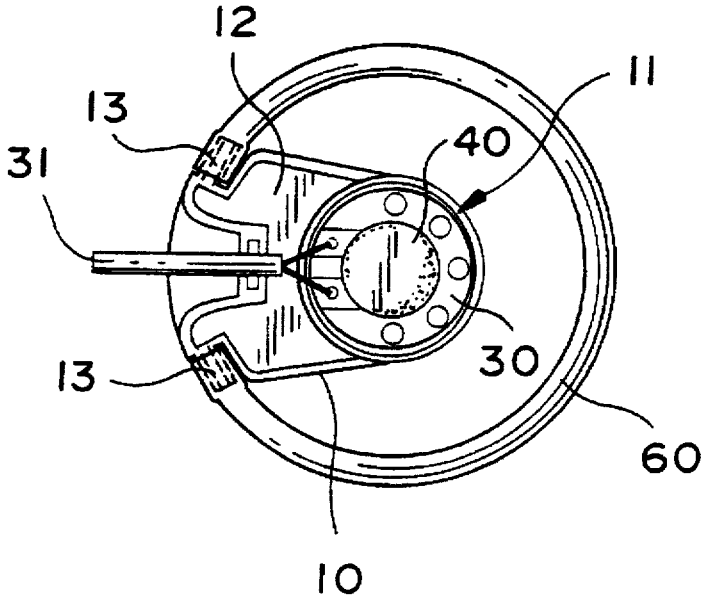
FIG. 7 is still a cross sectional view of the earphone shown in FIG. 4 taking along its traverse axis.
Figure 8:
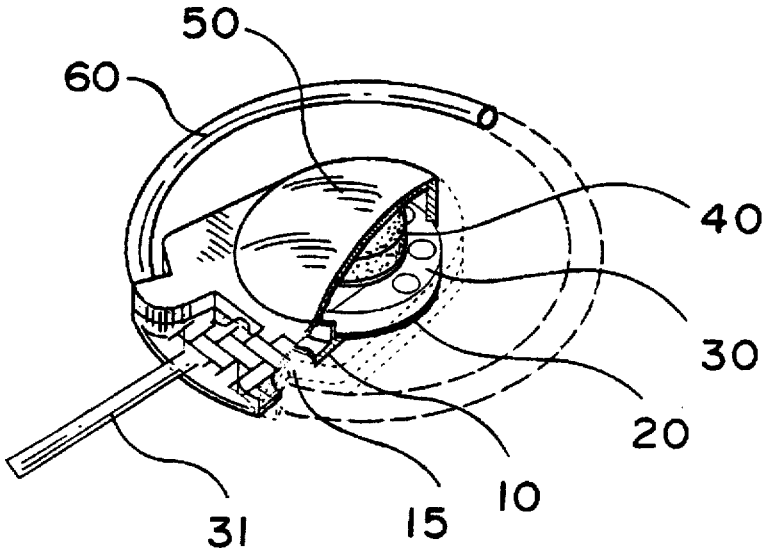
FIG. 8 is a cross sectional view of the earphone shown in FIG. 5 taking along its longitudinal axis.
Figure 9:
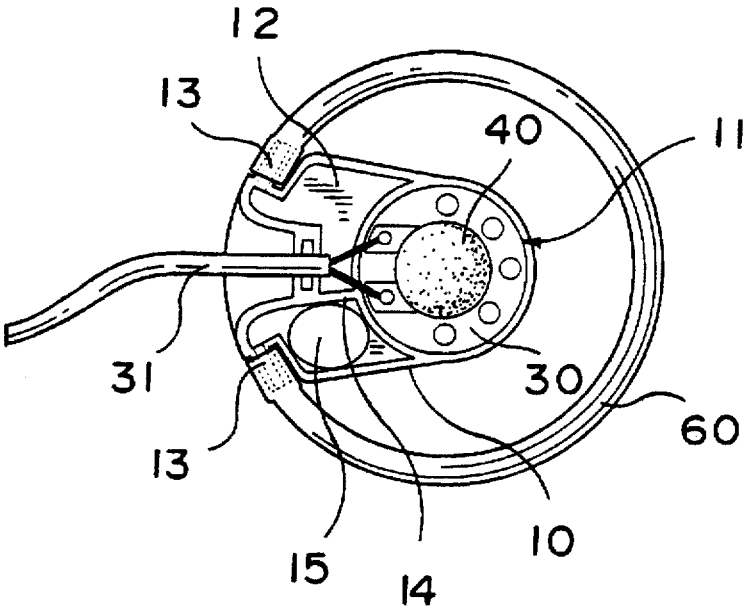
FIG. 9 is still a cross sectional view of the earphone shown in FIG. 5 taking along its traverse axis.
Figure 10:
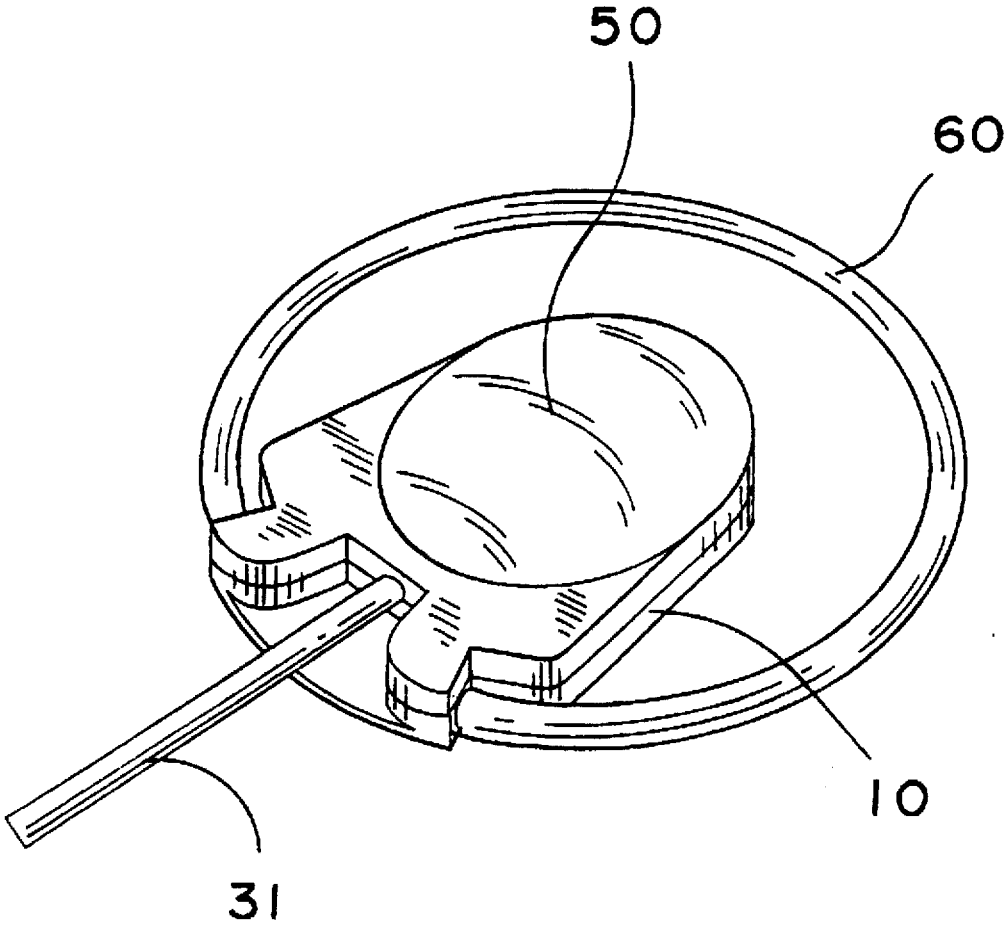
FIG. 10 is a perspective view of an assembled earphone made according to this invention.
Figure 14:
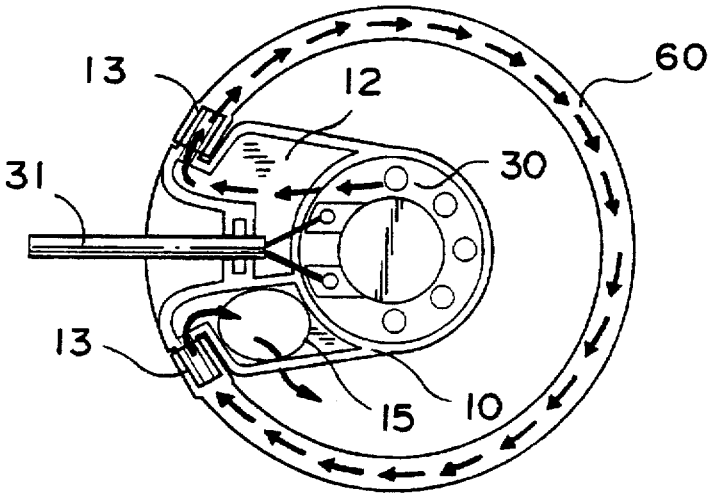
FIG. 14 shows the transmitting status of the rearward wave in a music-type earphone made according to the present invention.

As shown in FIGS. 5, 7 and 14, the earphone so constructed is for music listening. As described above, the sound wave directing chamber 12 is divided into a large and small spaces by the provision of the partitioning walls 14 and 51. The small space is isolated to the speaker chamber 11 and both spaces are communicated with the loop-type retainer 60. This means the larger and smaller spaces can communicate with each other by the loop-type retainer 60. When the speaker 30 receives signal transmitted from the signal transmitting wires 31, the diaphragm is resonated to generate a forward and rearward wave. The forward wave may enter the outer auditory canal directly from said speaker 11, while the rearward wave is transmitted into the larger space of the sound wave directing chamber 12 from the speaker chamber 11. As shown in FIG. 14, the rearward wave travels along the following path, i.e. the larger space->the sound directing tube 13->the loop-type retainer 60->the sound directing tube 13->the smaller space->the opening 15->outsides. By this arrangement, the travel path is largely extended which exactly meets the requirements of woofer which features low frequency and long wavelength. Consequently, the balance between tweeter, squawker and woofer is appropriately improved. Generally, the earphone is short with woofer, without frequency balance and sound is too high to listening. By the provision of the present invention, the quality of voice is ensured.

On the other hand, since the rearward sound wave travels a longer distance, it may reach to the auditory canal later. As a result, a stereo effect is achieved. This is very attractive to the hot fan.

By the provision of the present invention, the uncomfort, poor voice quality of the conventional earphone can be advantageously solved. The loop-type retainer 60 provided by the present invention can be suitable selected by the user and it may readily fix to the helix of the ear while provides features of safety and water-proof. The woofer is enhanced and the frequency is balanced. Furthermore, a stereo effect is provided.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

I claim:

1. An improvement to an earphone with a loop-type retainer including a housing, water-proof seal, a speaker, an ear cushion, an upper lid, a and loop-type retainer being removably attached to said housing, wherein said housing defines a speaker chamber therein, a sound wave directing chamber is extended rearward from said speaker chamber, each of the side of said sound wave directing chamber is provided with a sound wave directing tube which extends through said directing chamber;

said water-proof seal is disposed within said speaker chamber of said housing;

said speaker is disposed within said seal which is disposed within said speaker chamber of said housing, and signal transmitting lines are connected to said speaker;

said ear cushion has suitable diameter and thickness and is disposed at said speaker which is disposed within said speaker chamber of said housing;

said upper lid has the same contour as that of said housing, said upper lid encloses said housing, said speaker chamber communicates with said sound wave directing chamber; and said loop-type retainer is made from resilient material, said retainer being removably attached to said each sound directing tube of said housing and communicates therebetween.

2. An improvement to earphone as recited in claim 1, wherein said sound wave directing chamber is disposed with a partitioning wall and the upper lid and the speaker chamber are also provided with a partitioning wall with respect to said partitioning wall of said sound wave directing chamber, accordingly, said earphone assembly is divided into a large and small spaces wherein said large space is communicated with said speaker chamber and said small space is provided with an opening for communicating outside.

* * * * *